United States Patent [19]

Geyer

[11] 4,408,810

[45] Oct. 11, 1983

[54] RESILIENT SIDE BEARING

[75] Inventor: Robert P. Geyer, Palatine, Ill.

[73] Assignee: Standard Car Truck Company, Park Ridge, Ill.

[21] Appl. No.: 382,766

[22] Filed: May 27, 1982

[51] Int. Cl.[3] ..... F16C 19/00; B61F 5/14

[52] U.S. Cl. ..... 308/226; 308/224; 105/199 CB

[58] Field of Search ..... 308/224, 225, 226; 105/199 CB

[56] References Cited

U.S. PATENT DOCUMENTS

| | | | |
|---|---|---|---|
| 1,807,451 | 5/1931 | Stebbins | 308/226 X |
| 1,887,605 | 11/1932 | Tatum | 308/226 |
| 3,502,379 | 3/1970 | Ingram | 308/224 |
| 3,719,154 | 3/1973 | Reynolds | 105/199 CB |
| 3,981,548 | 9/1976 | MacDonnell et al. | 308/226 |
| 4,080,016 | 3/1978 | Wiebe | 105/199 CB X |

*Primary Examiner*—Stuart S. Levy

*Assistant Examiner*—Thomas R. Hannon

*Attorney, Agent, or Firm*—Kinzer, Plyer, Dorn & McEachran

[57] ABSTRACT

A constant contact resilient side bearing adapted to be positioned on a railroad car truck bolster and in constant contact with the underside of the car body for retarding movement of the car truck relative to the car body includes a housing adapted to be positioned on the bolster and which may, in some applications, be integrally cast with the bolster. A pair of rollers are mounted within the housing for contact with the underside of a car body, the rollers being arranged with their axes approximately parallel to the longitudinal axis of the bolster or generally having the roller axes intersect in the center of the center plate. A resilient elastomeric pad is positioned within the housing and beneath the rollers. The pad provides resistance to movement of the rollers responsive to relative rotation between the car truck bolster and car body underside.

10 Claims, 10 Drawing Figures

Fig. 7.
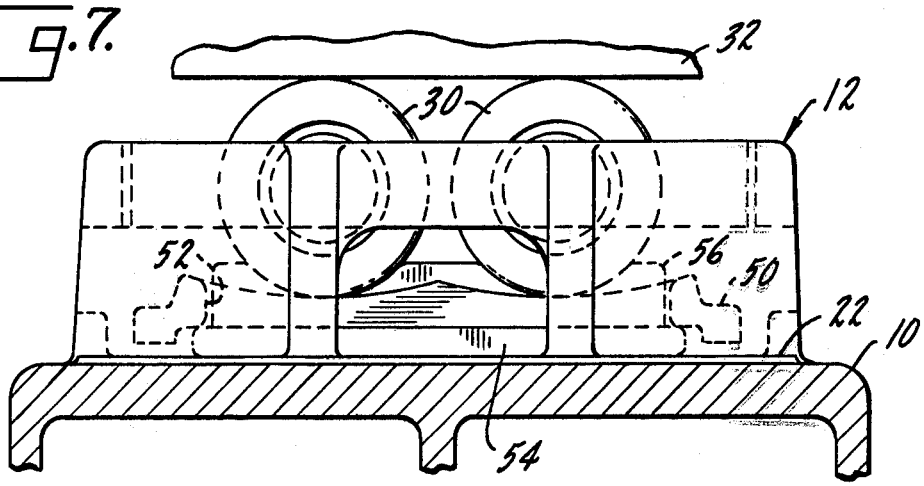
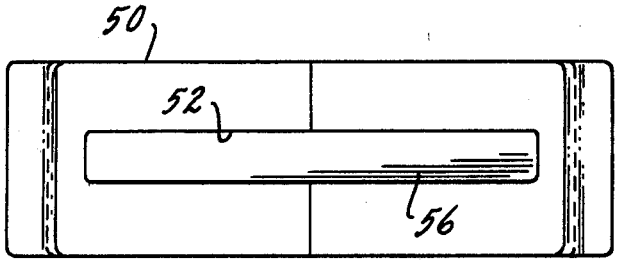
Fig. 8.
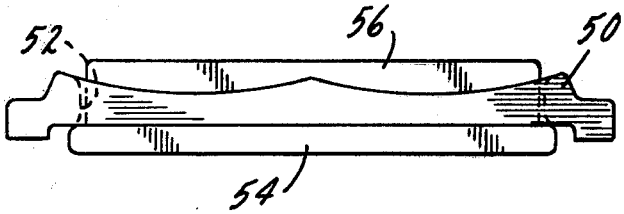
Fig. 9.
Fig. 10.
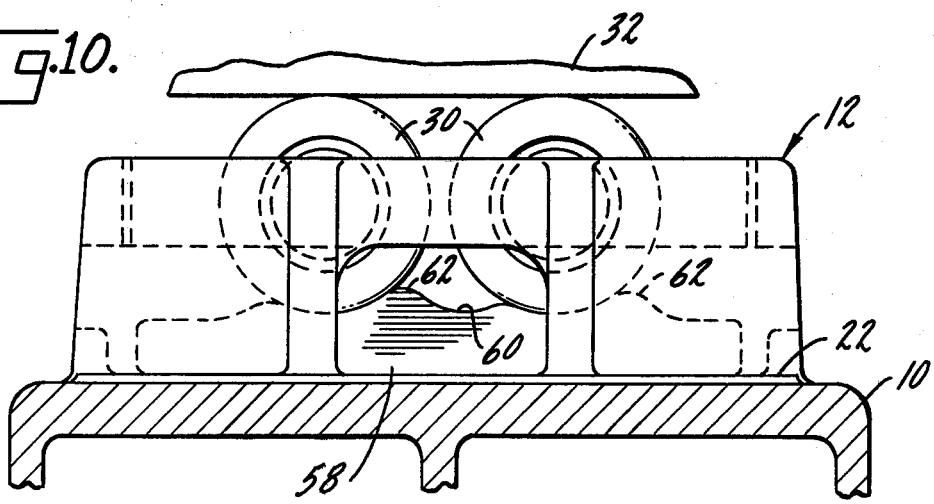

RESILIENT SIDE BEARING

SUMMARY OF THE INVENTION

The present invention relates to side bearings for retarding or resisting relative turning movement between a railroad car truck and the underside of the car body, such turning movement being conventionally encountered in what is known as a hunting condition.

A primary purpose of the invention is a constant contact resilient side bearing using rollers positioned within a housing on top of the bolster, with the rollers being in constant contact with the underside of the car body and with resistance to movement of the rollers being provided by an elastomeric pad positioned within the side bearing housing.

Another purpose is a side bearing structure of the type described in which the rollers are supported on an elastomer or elastomeric pad which has a wave-like contour to resist movement of the rollers.

Another purpose is a side bearing construction of the type described which includes a contoured bearing plate positioned within the side bearing housing and resting upon an elastomeric pad, the contour of the bearing plate and the elastomer resisting or retarding rolling movement of the rollers caused by turning movement between the car truck bolster and the underside of the car body.

Another purpose is a side bearing construction of the type described in which the contoured bearing plate recenters the rollers on tangent track.

Other purposes will appear in the ensuing specification, drawing and claims.

BRIEF DESCRIPTION OF THE DRAWINGS

The invention is illustrated diagrammatically in the following drawings wherein:

FIG. 7 is a side view of a modified side bearing, utilizing the housing of FIGS. 1, 2 and 3, FIG. 8 is a top plan view of the bearing plate and elastomeric pad used in the side bearing of FIG. 7, FIG. 9 is a side view of the bearing plate and elastomeric pad of FIG. 8, and FIG. 10 is a side view showing yet a further form of side bearing utilizing the same housing as in FIGS. 1 and 7.

DESCRIPTION OF THE PREFERRED EMBODIMENT

The present invention relates to a constant contact side bearing, which is resilient in nature and which inhibits high speed light car truck oscillation known as hunting, but which will permit or allow slower relative movement between the car truck and car body necessitated by curved track. Although both constant contact side bearings and side bearings using rollers are not new, the present invention uniquely combines rollers, a profiled bearing plate, an elastomeric pad which provides resistance to roller movement and the constant contact concept into a simple, reliably operable side bearing construction.

Figure 1:
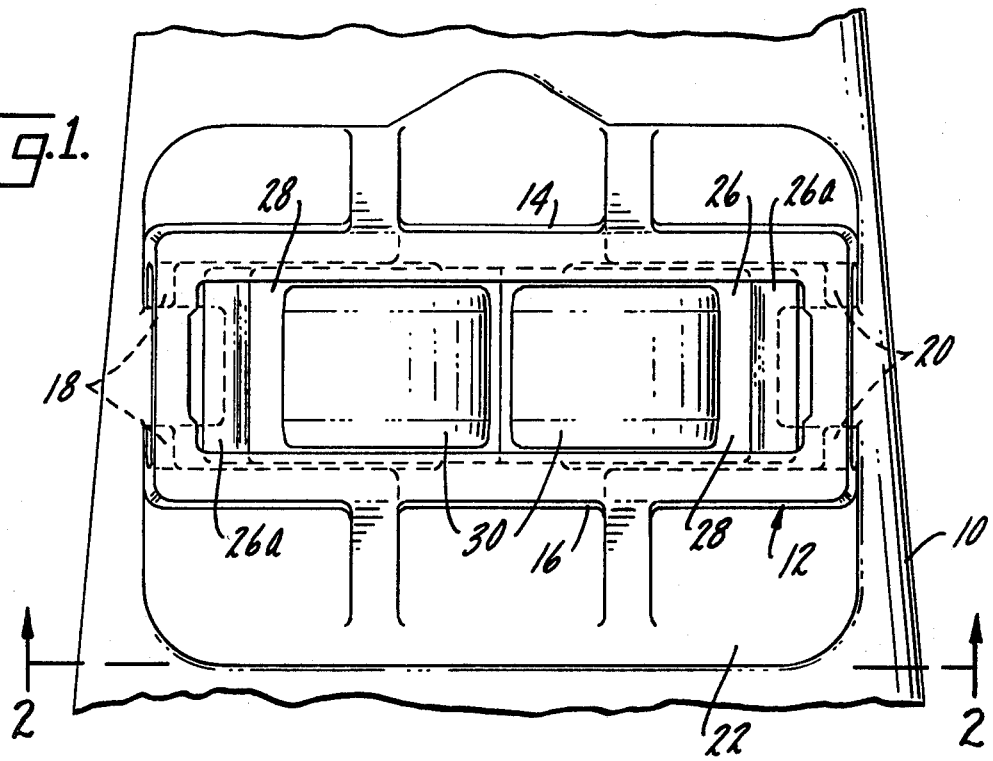
FIG. 1 is a top plan view of the side bearing, positioned on top of a car truck bolster.
Figure 2:
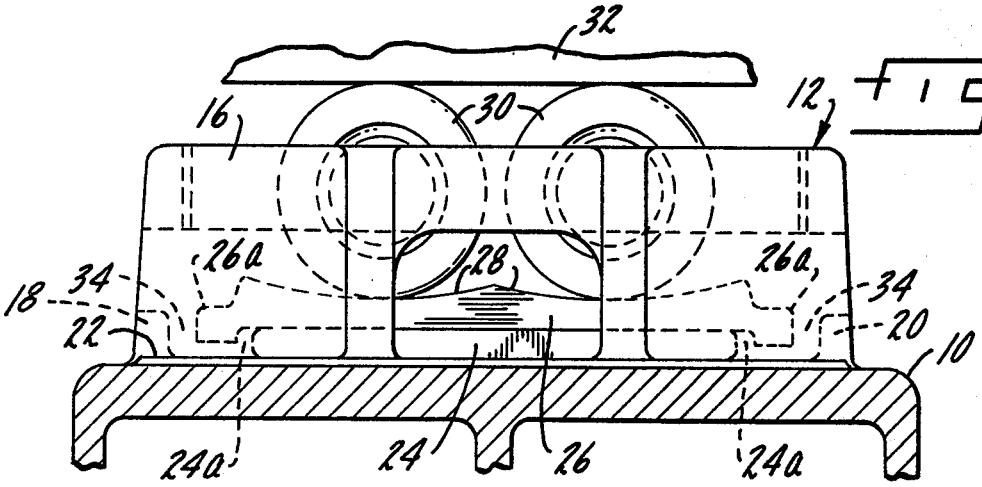
FIG. 2 is a side view along plane 2—2 of FIG. 1.
Figure 3:
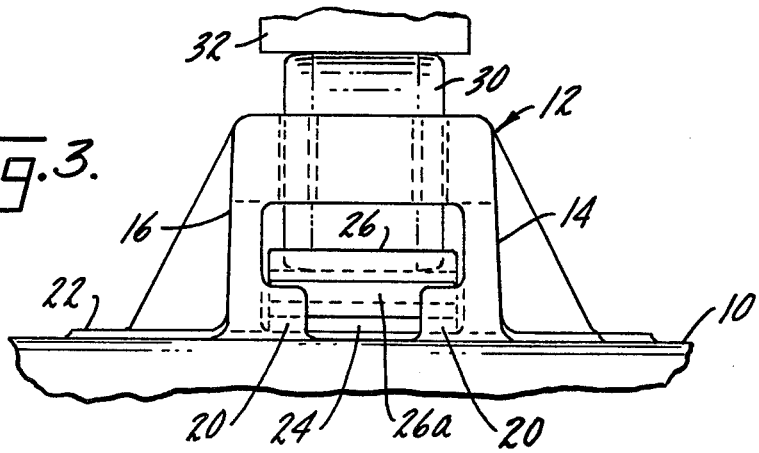
FIG. 3 is an end view of the side bearing of FIGS. 1 and 2.

In the embodiment of FIGS. 1, 2 and 3, the top of a typical car truck bolster is illustrated at 10 and the side bearing may include a housing 12, which in this specific embodiment will be integrally cast with bolster 10. Housing 12 has side walls 14 and 16 and lower end wall portions 18 and 20. The bottom of the side bearing housing is formed by the top of bolster 10 and more specifically by a slightly raised area 22.

Positioned within the confines of the side bearing housing, and on top of its bottom 22, is an elastomeric pad 24, generally rectangular in configuration, as specifically illustrated in FIG. 1. Pad 24 may be formed of a suitable elastomeric or rubberlike material and will have the flexibility and hardness required for the specific utility shown. Positioned on top of pad 24 and preferably bonded thereto is a hardened steel bearing plate 26 whose upper surface is contoured into two adjacent very gradual trough or wave-like areas 28. The underneath side of bearing plate 26 may have a recess so that the bearing plate will fit over the top of elastomeric pad 24. The pad may be slightly smaller in cross section than the bearing plate recess, as indicated by gaps **24*a* in FIG. 2**, to permit the elastomer to expand horizontally when subject to vertical loading.

Positioned on top of bearing plate 26 and spaced apart by the contoured or wave-like areas 28 are a pair of hardened steel rollers 30, the upper surface of which will bear against the lower surface of a body bearing plate 32 which will conventionally be attached to the underside of the car body.

Of importance in the side bearing construction is the fact that the bearing plate has end portions **26*a* which extend beyond the elastomeric pad and above raised area 22 so as to protect the pad from overload. Thus, the projections 26*a*, if an overload is applied by rollers 30, in either direction, will either contact end walls 18 or 20 or bottom upon raised area 22** to prevent permanent damage to the elastomeric pad.

In order to obtain and to maintain intimate contact of the rollers with the car body and specifically bearing plate 32, the side bearing will be preloaded so as to insure that there is always the requisite constant contact. This preload may be brought about during assembly of the car trucks to the car body or may be brought about by the use of shims, either beneath the elastomeric pad 24 or externally on the truck bolster under the attached housing or on the car body. The longitudinal axis of bolster 10 is parallel to the axis of rollers 30 so that when there is turning movement of the car truck relative to the car body, the rollers will turn upon their axes or roll.

What is important in a side bearing of the type described is to retard or resist the so-called hunting movement or high speed light car truck oscillation, but yet permit or allow the slower acting movement of the car truck necessary to negotiate curved track. Considering that the rollers in the FIGS. 1, 2 and 3 construction are preloaded, if there is relative movement between the bolster and the car body, and assuming the bolster is attempting to turn toward the left in FIG. 2, the rollers will be moved toward the left, but any rolling or turning movement of the rollers will be to the right and require them to move uphill or up the surface of the troughs or wavelike areas 28. Such uphill movement will tend to compress elastomeric pad 24 and thus the pad will provide the resistance to such uphill movement or resistance to relative rotation between the car truck and the car body. The bearing plate is contoured, concave, so that the rollers must move uphill when truck rotation is initiated and the resultant elastomer compression is the inhibiting factor to truck oscillation. An advantage of the specific contour of the bearing plate is that it tends to recenter or reposition the rollers on tangent track. The tendency of the rollers is to move back toward the center of their troughs when the car is on tangent track and the surface of the troughs will therefore assist in repositioning the rollers in their proper location.

If the applied force on the rollers is excessive, the bearing plate projections 26*a* may bottom out on the bottom of the side bearing housing to protect the elastomeric pad from permanent damage. Thus, there can be no overloading of the elastomer.

As specifically illustrated in FIG. 2, there is a gap or space 34 between the projections 26*a* of bearing plate 26 and lower end wall portions 18 and 20 to thus provide for the bearing plate and elastomeric pad assembly to move longitudinally in the housing through shear action when under load if the load reaches a point where the projections 26*a* have bottomed or compression rate of the elastomer may prevent the rollers' upward movement on the contoured bearing plate. The contour of the bearing plate resists movement of the rollers, but if the load applied to the rollers becomes sufficiently large, projections 26*a* may bottom on surface 22 with further bolster rotation causing a sliding action of the bearing plate or shear section of the elastomeric pad assembly.

Figure 4:
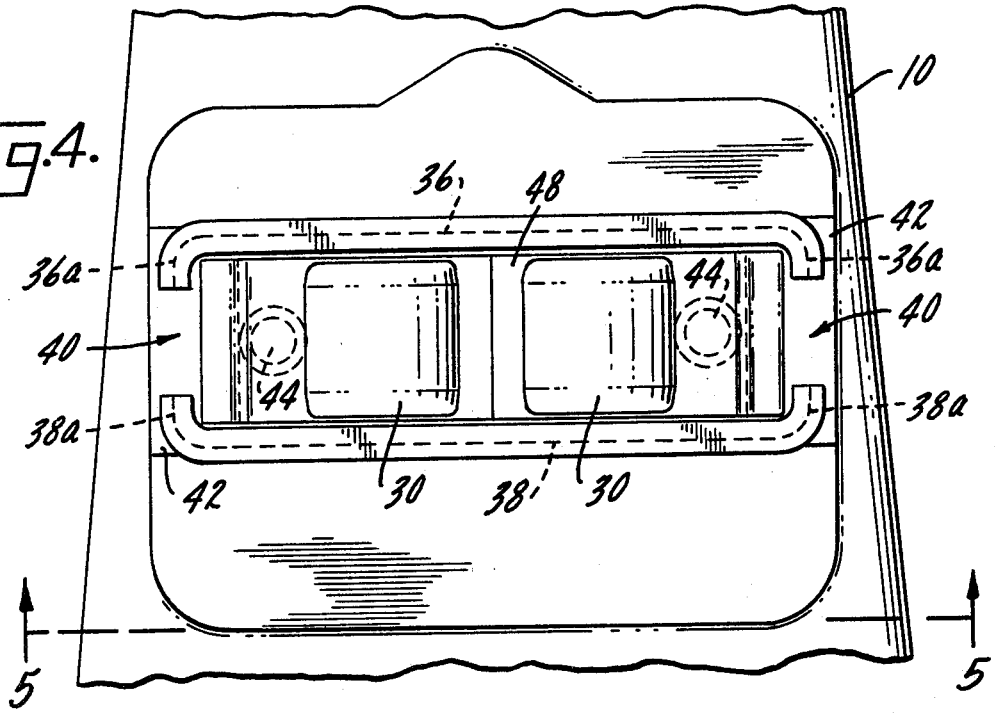
FIG. 4 is a top plan view, similar to FIG. 1, but showing a modified form of side bearing housing.
Figure 5:
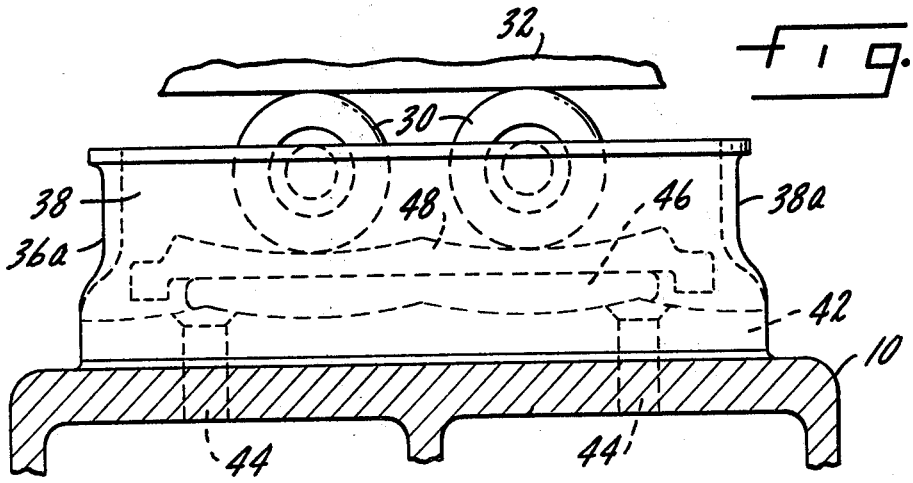
FIG. 5 is a side view taken along plane 5—5 of FIG. 4.
Figure 6:
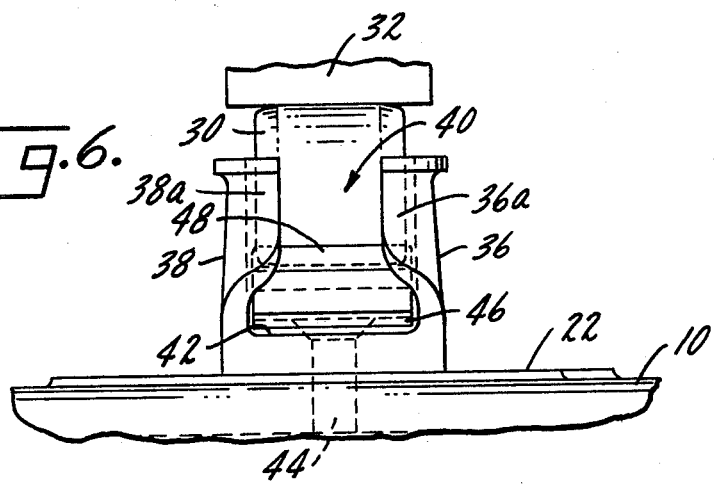
FIG. 6 is an end view of the side bearing of FIGS. 4 and 5.

The construction of FIGS. 4, 5 and 6 is similar to that of FIGS. 1, 2 and 3 in terms of the bearing plate, elastomeric pad and rollers. The principal difference is in the housing. The housing of FIGS. 1, 2 and 3 was integral with the bolster, whereas, the housing in FIGS. 4, 5 and 6 is a separately manufactured cage or housing which is fastened upon the top of the bolster. In this case the housing has side walls 36 and 38 with in-turned ends 36*a* and 38*a* which are separated by a small gap 40. There is a contoured bottom 42 which is mounted by fasteners 44 to the top of the bolster. Positioned on top of the contoured bottom 42 is an elastomeric pad 46 which itself has a bottom contour matching that of bottom 42. On top of pad 46 is a bearing plate 48 which may be similar in construction to that illustrated in FIGS. 1, 2 and 3. Again, the bearing plate and elastomer may be bonded together.

The utility or use of the construction in FIGS. 4, 5 and 6 is the same as that in FIGS. 1 and 2 with the addition of the contour on bottom 42 of the housing providing additional resistance to roller movement, as well as providing a degree of resistance to compression and/or shear movement of the pad and bearing plate under substantial loads, as described above.

The construction in FIGS. 7, 8 and 9 utilizes the same housing as in FIGS. 1, 2 and 3 and like parts have been given the same number. The bearing plate in FIGS. 7, 8 and 9 is indicated at 50, and in addition to the contoured upper surface, has a generally centrally located slot 52. Elastomeric pad 54 has an upwardly-directed center projection 56 which extends through slot 52 and is in contact with the bottom of the rollers. The protrusion of the elastomeric pad into the path of the rollers on the bearing plate provides instant resistance to roller movement on the relatively flat center areas of the trough-like contour of the upper surface of the bearing plate. Accordingly, such instant resistance is more effective in preventing the harmonic rotation buildup on hunting than is a construction without the protruding rubber.

In the construction of FIG. 10, which has the same housing as the FIGS. 1 and 7 constructions, the bearing plate has been eliminated and there is an elastomeric pad 58 positioned directly on top of the raised area 22 of the bolster and itself directly supports each of the rollers. The upper surface of elastomeric pad 58 is contoured, into a series of wave-like or trough areas 60, there being three illustrated in the FIG. 10 construction. The lower surface of pad 58 can be relatively flat as on elastomer pad 24 or contoured as on pad 46.

FIG. 10 illustrates the elastomeric pad under load and resisting left to right roller movement. Accordingly, it should be noted that the movement of the rollers toward the right tends to bunch up portions of the pad indicated at 62, directly adjacent to the right-hand side of the roller portion in contact with the pad. Thus, the contour of the pad directly ahead of roller movement, resists roller movement, as described above. The construction of FIG. 10 may provide more resistance to hunting or truck rotation, but will be more subject to wear than those constructions in which the pad is protected by a hardened steel bearing plate.

Although a pair of rollers have been described herein as providing the roller means, it should be understood that in some applications, only a single roller may be required. The rollers may be parallel to the longitudinal axes of the bolster, or the roller axes may intersect the center line of the center plate in which case there may be a slight divergence from the parallel, but still within the description of generally parallel.

Whereas the preferred form of the invention has been shown and described herein, it should be realized that there may be many modifications, substitutions and alterations thereto.

The embodiments of the invention in which an exclusive property or privilege is claimed are defined as follows:

1. A constant contact side bearing adapted to be positioned on a railroad car truck bolster and in constant contact with the underside of the car body for retarding turning movement of the car truck relative to the car body, said side bearing including a housing adapted to be positioned on the bolster, a pair of rollers mounted within said housing for contact with the underside of a car body, said rollers being arranged with their axes parallel to the longitudinal axis of the bolster, a contoured bearing plate positioned within said housing and supporting said rollers, an elastomeric pad positioned within said housing beneath and supporting said bearing plate, said contoured bearing plate and elastomeric pad providing resistance to rolling movement of said rollers responsive to relative rotation between the car truck bolster and car body underside.

2. The side bearing of claim 1 further characterized in that the surface of said bearing plate supporting said rollers has a wave-like contour, with rolling movement of said rollers being in an uphill direction, and with the contour of the bearing plate tending to recenter the rollers on tangent track.

3. The side bearing of claim 2 further characterized in that said bearing plate has a generally centrally located slot, with a portion of said elastomeric pad extending upwardly through said slot and being in contact with portions of said rollers.

4. The side bearing of claim 1 further characterized in that said elastomeric pad is bonded to said bearing plate.

5. The side bearing of claim 4 further characterized in that said housing is integrally cast with said bolster.

6. The side bearing of claim 4 further characterized in that said housing is separately attached to said bolster.

7. The side bearing of claim 4 further characterized in the opposite ends of said bearing plate extend beyond said pad and are spaced above the bottom of said housing to prevent an overload on said pad.

8. The side bearing of claim 4 further characterized in that opposite ends of said bearing plate and pad are spaced from the housing to provide for horizontal shear movement of the pad thereof relative to said housing.

9. The side bearing of claim 4 further characterized in that said bearing plate has a recess with said elastomeric pad being positioned within said recess and spaced from the sides thereof.

10. A constant contact resilient side bearing adapted to be positioned on a railroad car truck bolster and in constant contact with the underside of the car body for retarding turning movement of the car truck relative to the car body, said side bearing including a housing adapted to be positioned on the bolster, roller means mounted within said housing for contact with the underside of a car body, said roller means being arranged with its axis generally parallel to the longitudinal axis of the bolster, an elastomeric pad positioned within said housing, a hardened bearing plate positioned within said housing between said roller means and pad and supporting said roller means thereon, said pad providing resistance to rolling movement of said roller means responsive to relative rotation between the car truck bolster and car body underside.

* * * * *